United States Patent [19]

Harper et al.

[11] 4,279,348

[45] Jul. 21, 1981

[54] ADJUSTABLE DOUBLE LINK MOUNTING

[75] Inventors: Robert W. Harper, Metamora; Robert A. Kleiber, Washington, both of Ill.

[73] Assignee: Caterpillar Tractor Co., Peoria, Ill.

[21] Appl. No.: 23,198

[22] PCT Filed: Feb. 9, 1979

[86] PCT No.: PCT/US79/00080

§ 371 Date: Feb. 9, 1979

§ 102(e) Date: Feb. 9, 1979

[87] PCT Pub. No.: WO80/01682

PCT Pub. Date: Aug. 21, 1980

[51] Int. Cl.[3] ..... B66C 23/76

[52] U.S. Cl. ..... 212/196; 74/522; 280/758; 414/673

[58] Field of Search ..... 212/49, 8 B, 255, 258, 212/260, 261, 195–198; 414/719, 747, 745, 917, 673; 280/758, 759, 755; 74/522, 525

[56] References Cited

U.S. PATENT DOCUMENTS

| | | | |
|---|---|---|---|
| 2,722,320 | 11/1955 | Dobeus et al. | 212/49 X |
| 3,533,524 | 10/1970 | Wilcox | 212/49 X |
| 4,083,459 | 4/1978 | Allen | 212/49 X |

*Primary Examiner*—Leslie J. Paperner

*Assistant Examiner*—Edmond G. Rishell, Jr.

*Attorney, Agent, or Firm*—Wegner, Stellman, McCord, Wiles & Wood

[57] ABSTRACT

An adjustable double link mounting for interconnecting a pair of structures, such as structures (37, 51) mountable on a crawler vehicle (10), including at least a pair of spaced-apart lugs (44, 82, 83, 84, 85) on each of the structures and each having a bore, a pair of spaced-apart links (80,81) having a pivotal connection at each end to at least one lug as provided by a pin-receiving opening (91, 92, 105, 107) for receiving a pin (93, 94, 104, 106) which also extends through an apertured lug, and one (81) of the links including a turnbuckle (110, 111, 112) for adjusting the effective length thereof.

8 Claims, 4 Drawing Figures

52
51
61
21
10
11
18
14
22
12
24
23
13

3
10
47
39
44
24
21
43
48
37
48
43
38
41
38
3

ADJUSTABLE DOUBLE LINK MOUNTING

DESCRIPTION

1. Technical Field

This invention relates to an adjustable double link mounting for interconnecting a pair of structures, such as components which are removably connectable to the frame of a crawler vehicle.

2. Background Art

Relevant prior art includes U.S. Pat. No. 4,083,459, issued Apr. 11, 1978 to Allen, and owned by the assignee of this application.

The Allen patent shows a crawler vehicle with structure detachably mounted thereto to enable reduction in over-all width of the vehicle during transport thereof. As a specific example, the crawler vehicle is a crawler pipe-layer in which a boom assembly is mounted at one side of the vehicle and a counterweight assembly mounted on the opposite side. The pipe-layer, when fully assembled, almost always exceeds the allowable width and weight for shipment and, thus, the boom and counterweight assemblies must be removed for shipping and then reinstalled at the job site. In the assembly or reinstallation at the job site, it is necessary to interconnect a number of structures to components of the crawler vehicle and to each other, which is commonly done by pin connections.

In the prior art, as shown in the above-mentioned patent, there is a single link which connects a winch mechanism to a mounting frame. Experience has established that the single link is not of sufficient structural strength because of loads encountered during use of the boom assembly and two links are used to provide adequate strength. With use of two links, it has been difficult to obtain proper alignment between the ends of the links and the structure to which they are connected during reinstallation on the site because of the buildup of tolerances in the various mounting connections between the components.

DISCLOSURE OF INVENTION

The present invention is directed to overcoming one or more of the problems as set forth above.

According to the present invention, an adjustable double link mounting for interconnecting a pair of structures includes at least a pair of members on each of said structures and each having a pin-receiving bore and a pair of interconnecting spaced-apart links for receiving pins passing through said bores and openings in the ends of said links and means providing for adjustment of one link relative to a member to facilitate alignment between a bore and an opening preparatory to receiving a connecting pin.

BEST MODE FOR CARRYING OUT THE INVENTION

Figure 1:
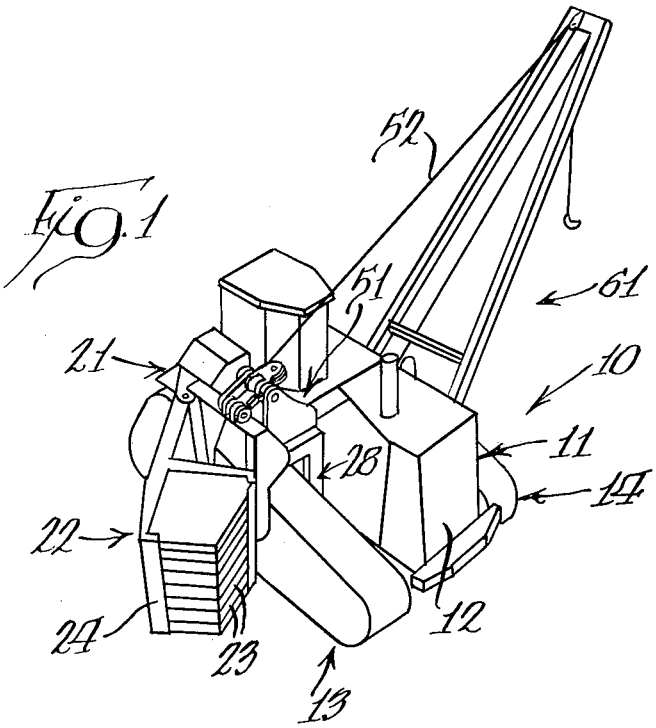
FIG. 1 is a perspective view of a crawler pipe-layer in which the adjustable double link mounting is utilized.
Figure 2:
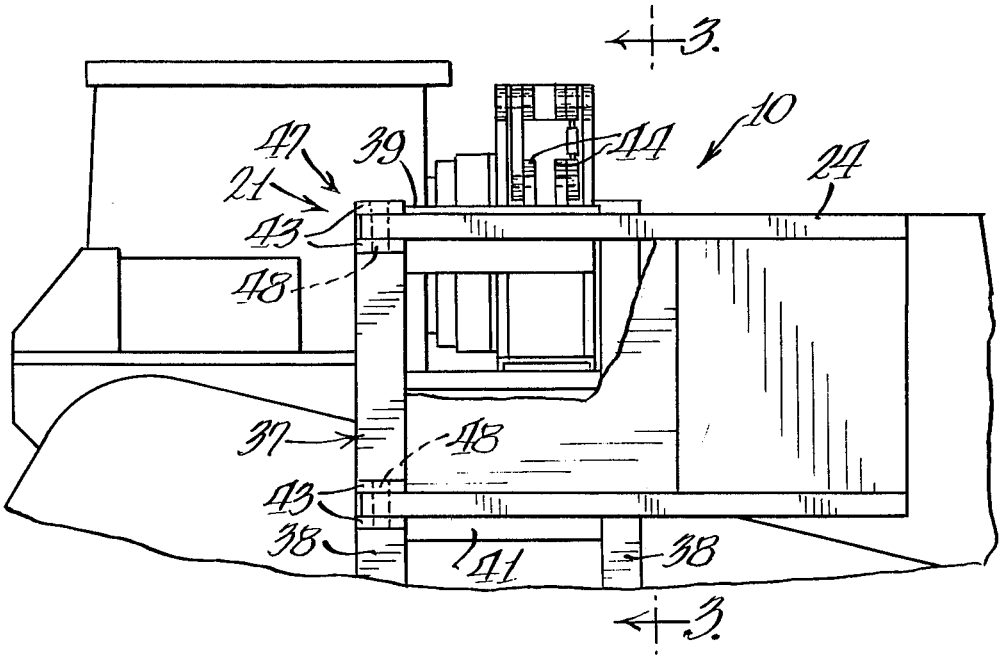
FIG. 2 is a fragmentary side elevational view of the pipe-layer shown in FIG. 1.

Referring to FIGS. 1 and 2, a crawler pipe-layer, generally indicated by the reference numeral 10, includes a crawler vehicle 11 having a main frame 12 extending along a longitudinal axis of the vehicle. A pair of track assemblies, indicated generally at 13 and 14, is disposed on opposite sides of the main frame. Each track assembly includes a roller frame 16 (FIG. 3) and the roller frames are interconnected by a laterally-extending hard bar 17. Each end of the hard bar 17 is disposed between a pair of longitudinally-spaced lugs secured to the inboard side of the roller frame. One of the lugs at each end of the hard bar is shown at 18. A pair of pins 19 connects each end of the hard bar to the respective pair of lugs and extends parallel to the longitudinal axis of the vehicle. The hard bar 17 is secured, as by welding, to the underside of the main frame adjacent to the forward end of the vehicle.

A mounting apparatus 21 is provided for fastening a counterweight assembly 22 to the vehicle on the outboard side of the track assembly 13. The counterweight assembly includes a plurality of counterweights 23 carried on a support structure 24.

Figure 3:
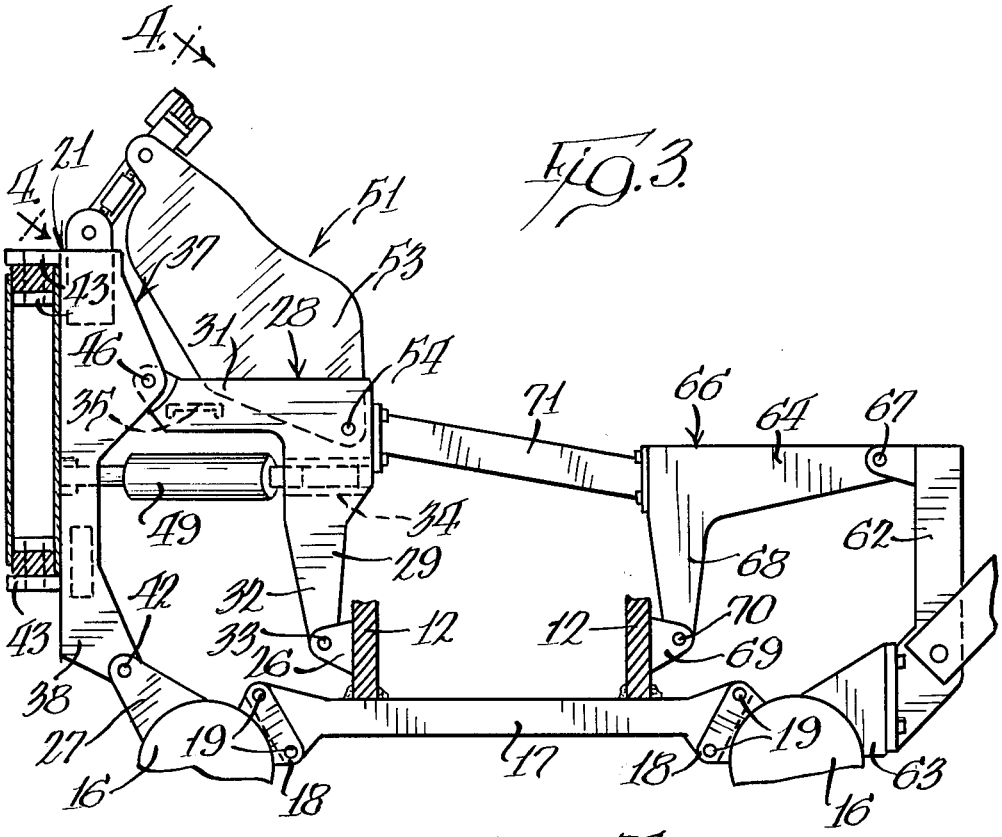
FIG. 3 is a sectional view, taken generally along the line 3—3 in FIG. 2.

The mounting apparatus 21 includes a first pair of brackets longitudinally spaced from each other and secured to the main frame 12 adjacent to the track assembly 13, with one bracket being shown at 26 in FIG. 3. A second pair of longitudinally-spaced brackets is secured to the outboard side of the roller frame 16 of the track assembly 13, with one bracket being shown at 27.

One of the interconnected mounting structures includes a frame assembly 28 having a first pair of longitudinally spaced-apart arms 29 and a second pair of longitudinally spaced-apart arms 31. The first pair of arms is positioned generally vertically between the main frame 12 and the track assembly 13. Each of the arms of the first pair has a lower end portion 32 connected to one of the pair of brackets 26 by a first pin 33. Each of the second arms 31 projects laterally outwardly relative to the first pair of arms and over the track assembly 13. A first structural member 34 extends between the first pair of arms 29 and a second structural member 35 extends between the second pair of arms 31.

A counterweight mounting frame 37 includes a pair of vertically-extending longitudinally-spaced legs 38 which are interconnected by a pair of vertically-spaced longitudinally-extending braces 39 and 41. A lower end of each leg 38 is connected to one of the second pair of brackets 27 by a pin 42 (FIG. 3). Two pairs of vertically-spaced ears 43 project outwardly from the rear leg 38 and a pair of spaced-apart lugs or ears 44 project upwardly from the upper brace 39. The outer ends of each of the second arms 31 of the frame assembly 28 are detachably fastened to the upper portion of the counterweight mounting frame by a pin 46.

A hinge means, indicated generally at 47, attaches the rearward end portion of the support structure 24 of the counterweight assembly 22 to the mounting frame 37 for swinging movement in a substantially horizontal pathway between a retracted position, in which a larger portion of the counterweights 23 is positioned above the forward end of the track assembly 13 and an extended position in which the counterweights are disposed outwardly beyond the extremity of the track assembly. The hinge means includes a pair of vertically-oriented axially-aligned hinge pins 48 which pivotally fasten the rearward end portion of the support structure 24 to the ears 43.

A fluid jack 49 is pivotally fastened to the first member 34 of the frame assembly and has its rod end pivotally connected to the support structure 24 of the counterweight assembly 22. Extending the jack causes the counterweights to be swung toward a fully-extended position.

A winch mechanism 51 includes a pair of power-driven winches suitably mounted to a winch support structure 53 and which control the movement of a cable 52. The lower end of the winch support structure 53 is pin-connected to the frame assembly 28 at two locations by pins, with one shown at 54. The upper outer end is connected to the lugs 44 by structure to be described.

A boom assembly, indicated generally at 61, is disposed at the side of the crawler vehicle 11 opposite to the side mounting the counterweight mechanism. The boom assembly is pivotally mounted to a boom mounting frame 62 which has its lower end secured to a bracket 63 extending outwardly from the roller frame 16 of the track assembly 14. The upper end of the boom mounting frame is connected to an outwardly-projecting arm 64 of a frame assembly 66 by a pin 67. A downwardly-projecting arm 68 is pinned to a bracket 69 by a pin 70, with the bracket secured to the main frame 12 adjacent the track assembly 14. A rigid cross member 71 has its opposite ends secured to the frame assemblies 28 and 66. The boom assembly 61 supports the cable 52 with the operation of the cable being controlled by the winch mechanism 51.

To prepare the crawler vehicle for shipment, the counterweight mounting frame 37 and counterweight assembly 22 are separated from the crawler vehicle as a unit. The mounting frame 37 is removable after separation from the winch mechanism 51 by release of the connecting structure to be described and release of the connection to the rod end of the fluid jack 49. The pins 42 and pins 46 are then removed so that the mounting frame 37 is disconnected from the frame assembly 28 and the second brackets 27. During this removal operation, the winch mechanism 51 is lowered to rest on the structural member 35. The removed structure can be reinstalled subsequently by performing the above steps in reverse order.

Similarly, the boom assembly 61 and boom mounting frame 62 can be disconnected from the bracket 63 and frame assembly 66. This removal of structure from both sides of the crawler vehicle substantially reduces the maximum width of the crawler vehicle for transport thereof.

The foregoing structure is generally as shown in the previously referred to Allen U.S. Pat. No. 4,083,459 and the disclosure thereof is incorporated herein by reference.

The structure shown in the Allen patent utilized a single link to interconnect the counterweight mounting frame 37 and the winch mechanism 51. This single link structure has not been satisfactory because of side loading on the winch mechanism resulting from the angle of the cable 52. A stronger construction is provided by a double link mounting (FIG. 4) wherein a pair of links 80 and 81 extends between the lugs 44, carried by the brace 39 and two pairs of lugs or ears associated with the winch mechanism 51. The link 80 is associated with a pair of lugs 82 and 83, which are spaced apart to receive an end of the link 80 therebetween and the link 81 is associated with a pair of lugs 84 and 85 which are spaced apart to receive an end of the link 81 therebetween. Each of the lugs 44 has a bore 90 to align with pin-receiving openings 91,92 at an end of each of the links 80 and 81 to receive the respective connecting pins 93 and 94. Each of the lugs 82, 83, 84, and 85 has a bore 100, 101, 102, and 103, respectively, to receive a pin 104 which extends through a pair of the bores and an opening 105 formed in the link 80 and a pin 106 which extends through the bores of the lugs 84 and 85 and an opening 107 in the link 81.

Figure 4:
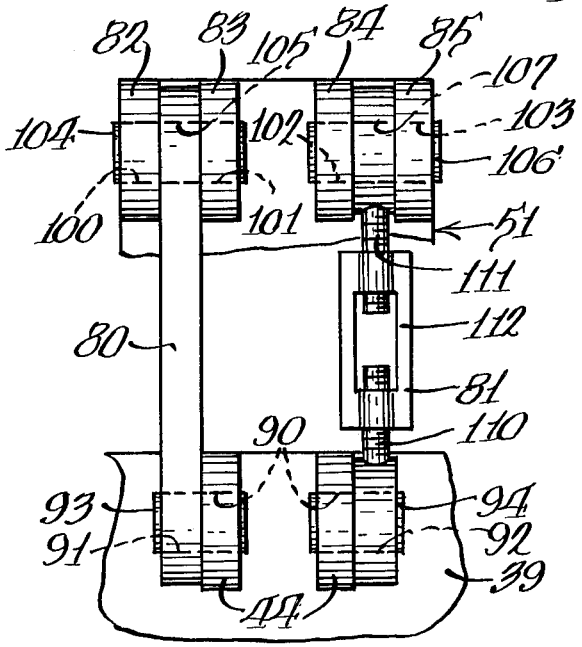
FIG. 4 is a fragmentary view on an enlarged scale of the adjustable double link mounting and taken generally along the line 4—4 in FIG. 3.

The parts are shown in assembled relation in FIG. 4. In connection with the previously described separation of structure from the crawler vehicle to reduce the width thereof, the pins 104 and 106 are removed to separate the winch mechanism 51 from the mounting frame 37. For reinstallation, the parts are brought back into alignment and the pins 104 and 106 are reinserted. However, difficulty is encountered in obtaining alignment between the lug bores and the opening of the second link to be connected primarily because of the buildup of tolerances in the various pin connections between the parts. This problem is overcome by means which provides for adjustment of one of the links and associated lugs relative to the other to facilitate alignment of a link opening with the bores of the lugs preparatory to receiving a connecting pin. More particularly, the link 81 is shown in the form of a turnbuckle having a pair of threaded eye-bolts 110 and 111 having threads of opposite hand, with one having a right-hand thread and the other having a left-hand thread and each threaded into a connecting member 112. Each of the eye-bolts provides an opening, previously defined, to receive the connecting pins 94 and 106. The connecting member 112 is rotatable to vary the effective length of the link 81 and to obtain the necessary alignment for making the final pin connection.

INDUSTRIAL APPLICABILITY

From the foregoing, it will be seen that an adjustable double link mounting for interconnecting a pair of structures enables interconnection between the parts having parallel mounting bores. When the removable structure is to be reinstalled, the mounting frame 37 is placed in mounted position by the previously-described pin connections and the winch mechanism 51 is moved into operating position. The link 80 which has retained its connection to the upper brace 39 is then positioned between the lugs 82 and 83 and the pin 104 inserted. The link 81, which has also retained its connection to the upper brace 39, is then moved into position between the lugs 84 and 85 and the connecting member 112 rotated to the extent necessary to obtain power alignment for insertion of pin 106. This structure provides a sturdy, double link interconnection between the parts and between parallel bores of lugs carried thereby. Without the adjustable double link mounting, it would be necessary to have a loose tolerance between the pin 106 and the bores through which it extends. However, with the disclosed structure, a close tolerance can be maintained because of the ability to adjust the alignment between the components.

We claim:

1. An adjustable double link mounting for mounting a first structure (37) removably to a second structure (51) in an accurately spaced relationship, comprising:

a pair of spaced-apart lugs (82,85) on one of said structures, each lug having a bore (100,103) defining an aperture;

a pair of interconnecting spaced-apart links (80,81) having a pivotal connection at one end to the other of said structures, and at the other end to a lug and provided by a pin-receiving opening (105,107) for receiving a pin (104,106) which extends through one of the apertured lugs, one of said links having a fixed length at all times to define means for establishing a preselected accurate spacing of said second structure from said first structure when connected therebetween; and means (110,111,112) providing for adjustment of the length of the other of said links to align the opening thereof with the bore of the lug to which it is to be pinned with said one link free of stress tending to axially disalign the pin received thereby relative to the lug pin-receiving openings through which that pin extends.

2. A mounting as defined in claim 1 wherein said adjustment-providing means includes a turnbuckle (110, 111, 112) associated with said one link (81) to enable varying the length of said one link.

3. A mounting as defined in claim 1 wherein said other link (81) has a pair of threaded eye-bolts (110,111) in end-to-end relation with one having a right-hand thread and the other having a left-hand thread and a connecting member (112) threaded to said eye-bolts and rotatable to vary the length of said other link.

4. In a vehicle having a main frame (12) extending along a longitudinal axis of the vehicle and a plurality of mounting structures (37, 51) which are attachable and detachable relative to each other and the main frame, a double link movable interconnection between two of said structures including a pair of spaced-apart apertured lugs (44, 82, 85) on each of said two structures, a pair of spaced-apart links (80, 81) having a pin-receiving opening at each end thereof for alignment with one of said apertured lugs to receive a connecting pin (93, 94, 104, 106) extended therethrough to provide a pivotal connection between the links and lugs and establish an accurately spaced relation between said two structures, one of said links having a fixed length at all times to define means for establishing a preselected accurate spacing of said two structures from each other, and the other of said links (81) having means (110, 111, 112) for adjusting the length thereof to align a pin-receiving opening thereof with an aperture of one lug to which it is to be pinned with said one link free of stress tending to axially disalign the pins received thereby relative to the aperatures of the lugs through which those pins extend.

5. A vehicle as defined in claim 4 wherein said other link (81) includes a turnbuckle (110, 111, 112) to provide said adjustment.

6. In a crawler vehicle having a main frame (12) extending along a longitudinal axis of the vehicle, first and second track assemblies (13,14) disposed at opposite sides of the main frame with each of the track assemblies having a roller frame (16), a counterweight assembly (22), a winch mechanism (51), and a plurality of removable pin connections (42,46,54) connecting said assembly and mechanism to the main frame and one of the track assemblies, the improvement in the form of an adjustable double link mounting enabling releasable connection of the winch mechanism to the counterweight assembly and comprising:

a pair of spaced-apart lugs (44) extending from said counterweight assembly and each having a bore (90);

two pairs of spaced-apart lugs (82,83,84,85) on said winch mechanism and each having a bore (100,101,102,103);

a pair of closely spaced, relatively short links (80,81) with each having a bore (91,92,105,107) at each end thereof to align with the bore of a lug on the counterweight assembly and the bores of a pair of lugs on the winch mechanism, one of said links having a fixed length at all times to define means for establishing a preselected accurate spacing of said counterweight assembly from said winch mechanism when connected therebetween;

pin means (93,94,104,106) positionable in said bores with a relatively close tolerance for rigidly interconnecting the links to said lugs; and means for adjusting the length of the other of said links relative to the length of said fixed length link to provide alignment between the bore of said other link and the bore of the associated lugs preparatory to interconnection by said pin means thereby to cause said fixed length link to be free of stress tending to axially disalign the pin received thereby relative to the lug pin-receiving openings through which that pin extends.

7. In a crawler vehicle as defined in claim 6 wherein said other link (81) is in the form of a turnbuckle (110, 111, 112).

8. In a crawler vehicle as defined in claim 7 wherein said other link (81) has a pair of eye-bolts (110, 111) with threads of opposite hand and which are threaded into opposite ends of a connecting member (112).

* * * * *